US005222289A

United States Patent [19]

Michalewski et al.

[11] Patent Number: 5,222,289

[45] Date of Patent: Jun. 29, 1993

[54] METHOD AND APPARATUS FOR FASTENING

[75] Inventors: David Michalewski, Cheektowaga; Robert J. Kellner, Orchard Park; James J. Birke, N. Tonawanda; Mark J. Andrews, Niagara Falls; Steven Gross, Lancaster, all of N.Y.

[73] Assignee: Gemcor Engineering Corp., Buffalo, N.Y.

[21] Appl. No.: 783,110

[22] Filed: Oct. 25, 1991

Related U.S. Application Data

[63] Continuation-in-part of Ser. No. 550,514, Jul. 10, 1990, Pat. No. 5,060,362.

[51] Int. Cl.[5] ..... B21J 15/02

[52] U.S. Cl. ..... 29/524.1; 29/525.2; 29/703

[58] Field of Search ..... 29/407, 524.1, 525.2, 29/559, 701, 703; 227/5, 51, 58

[56] References Cited

U.S. PATENT DOCUMENTS 5,060,362 10/1991 Birke et al. ..... 29/525.2

*Primary Examiner*—Timothy V. Eley
*Assistant Examiner*—Kenneth J. Hansen
*Attorney, Agent, or Firm*—Hodgson, Russ, Andrews, Woods & Goodyear

[57] ABSTRACT

A method and apparatus (10) for fastening upper and lower workpieces (20, 22) without movement of the workpieces. The apparatus is provided with a frame having upper and lower portions (24.1, 24.2) carrying upper and lower riveting ram assemblies (26, 28), respectively. Each riveting ram assembly includes a buck ram (30 or 32), a buck ram moving assembly (62 or 90, 92), a pressure foot (34 or 36), a pressure foot moving assembly (38 or 40), a buck ram position measuring device (74 or 104), and a pressure foot position measuring device (78 or 108). The upper pressure foot moving assembly (38) further includes an upper pressure foot compensation cylinder assembly (42). The apparatus also includes a load cell (112) carried by one of the buck rams for sending a force signal in response to the force being applied to the fastener during upset and thereafter. A programmable process controller (82) is provided which is capable of having programmed into it the length of a fastener, and a deflection compensation table which sets forth the deflection of a portion of the frame during upset. The controller modulates sequential operation of the various moving assemblies during operation to move the buck rams and the pressure feet in response to signals received from the position measuring devices and the load cell in such a manner that the fastener may be upset while maintaining the upper surface (122) of the upper workpiece (20) in a desired workplane (124) even though one portion of the frame may deflect more than another portion of the frame.

15 Claims, 2 Drawing Sheets

METHOD AND APPARATUS FOR FASTENING

CROSS REFERENCE TO A RELATED APPLICATION

This application is a continuation-in-part of Ser. No. 07/550,514 filed Jul. 10, 1990 entitled "Slug Riveting Method And Apparatus With C-Frame Deflection Compensation", now U.S. Pat. No. 5,060,362 issued Oct. 29, 1991.

TECHNICAL FIELD

The present invention relates generally to a method and apparatus for upsetting fasteners to secure two or more workpieces together, and more particularly to a method and apparatus for fastening two or more workpieces together by upsetting wherein the workpieces are maintained at a substantially constant level during upsetting of the fastener.

BACKGROUND OF THE INVENTION

In the aircraft industry various components of an aircraft wing are secured together by fasteners such as rivets and slugs. A slug is a metal fastener which typically does not have a preformed head and which has both ends deformed during riveting. A rivet is a metal fastener which has a preformed head and has only the tail deformed during riveting. Because of the large number of slugs and rivets utilized to produce a single aircraft wing, and also because of the requirements of virtually indefinite life of the deformed fasteners, much attention has been given in the industry to various methods and apparatus for upsetting. One upsetting method and apparatus is shown in U.S. Pat. No. 4,908,928. When practicing the method and apparatus disclosed in the aforementioned patent, upper and lower upsetting rams, (which are typically referred to as riveting rams), are carried by cylinder assemblies, the cylinder assemblies being mounted in upper and lower portions of a generally C-shaped frame, such as that shown schematically in FIG. 1 of U.S. Pat. No. 4,864,713. According to the method and apparatus of U.S. Pat. No. 4,908,928, after the upper and lower riveting rams have been snugged against the slug in the workpieces, fluid is simultaneously introduced into the cylinders behind each of the upper and lower riveting rams to move the rams together at substantially the same rate with respect to the cylinders. As the upper and lower riveting rams are moving at the same rate with respect to the cylinders there is little movement of the workpiece during upset of the slug. In other words, the workpieces will not move, or will barely move, relative to a fixed workplane. Movement of the workpieces with respect to a fixed workplane is known in the industry as "wink". If the workpieces are winked or moved during the squeeze cycle of an upsetting or riveting process, they will have a tendency to oscillate before returning to their original position. This oscillation could delay the next forming operation or any other subsequent operation. Greater uniformity of the bulging of the fastener may be achieved if there is limited movement of the workpieces during upset, which is desirable for fastener fatigue life cycles. The limited movement of the workpiece during slug forming or riveting permits clamping the workpieces into a rigid fixture which guarantees the accuracy of workpiece geometry. Since the fastening tooling does not "wink" or lift the workpieces, there is a reduced chance that the tooling will mar the surface of the workpiece which is engaged by the tooling.

When using the machine of U.S. Pat. No. 4,908,928, many of the foregoing objectives have been achieved. However, the foregoing machine included a midpoint supported C-frame which can be shifted vertically, and which can also be rocked and tilted so that the riveting rams may be positioned perpendicular to the surface of the upper workpiece which is held in a stationary manner. However, in some instances, it is desirable to support the workpieces, which may be an aircraft wing, for vertical and titling movement while supporting the riveting rams for X and Y movements only in the horizontal plane. In this situation, the riveting rams are typically supported by upper and lower portions of a large C-shaped frame, only a lower portion of the C-shaped frame being rigidly supported. When using this form of device, the upper portion of the C-shaped frame may deflect more during upsetting of the fastener than the lower portion of the C-shaped frame. When there is greater deflection of the upper portion of the C-shape frame, it can be appreciated that the workpieces being engaged by the riveting rams will be winked as the center point between the rams will move upwardly as the upper portion of the C-shaped frame is being deflected during upsetting. In some applications this winking is undesirable and therefore it is desirable that a method in apparatus be developed which will compensate for frame deflection.

In a more recent patent application about to be issued Oct. 29, 1991 as U.S. Pat. No. 5,060,362, a method and apparatus are disclosed for overcoming deflection of the upper portion of the C-shaped upsetting apparatus, the lower portion of the apparatus being mounted upon the floor. The design shown in U.S. Pat. No. 5,060,362 utilizes the same concepts as shown in the previously mentioned U.S. patent wherein a single master cylinder assembly in turn drives two slaved cylinder assemblies to provide fluid for both the upper and lower cylinders. Additional, fluid is added into the fluid lines for the upper upsetting cylinder assembly by means of a frame compensation booster cylinder assembly. The fluid flow into the frame compensation booster cylinder assembly is controlled by a servo valve, with feed back being provided by a linear transducer associated directly with the frame compensation booster assembly. While this form of device has proved to be satisfactory in its operation, it is somewhat complex.

OBJECTS OF THE PRESENT INVENTION

It is an object of the present invention to provide an improved method apparatus for fastening together two or more side-by-side workpieces by upsetting a fastener while maintaining the upper surface of the upper workpieces in a desired workplane.

According to one aspect of this invention, a frame is provided having upper and lower portions, and upper and lower riveting ram assemblies are carried by each of the portions, each riveting ram assembly including a buck ram, buck ram moving means, a pressure foot, pressure foot moving means, a buck ram position measuring means for measuring the position of the associated buck ram over a range movement with respect to the associated frame portion, and a pressure foot position measuring means for measuring the position of the associated pressure foot over range of movement with respect to the associated frame portion. The apparatus further includes a load cell carried by one of the buck rams for sending a force signal in response to the force being applied to the fastener during upset and thereafter. The apparatus further includes programmable process control means which is capable of having programmed into it a deflection compensation table, the length of the fastener, and the height of the head of the fastener if the fastener is a rivet. The programmable process controls means modulates sequential operation of the various moving means to move the buck ram and the pressure feet in response to signals received from the position measuring means and the load cell in such a manner that the fastener may be upset while maintaining the upper surface of the upper workpiece in the desired workplane even though one portion of the frame may deflect more than another portion of the frame during upset. In accordance with this invention the upper pressure foot moving means may further include an upper pressure foot compensation cylinder assembly.

It is a further aspect of the present invention to provide a method for operating the apparatus set forth above wherein initially the upper pressure foot is so positioned that its lower surface lies in the desired workplane when extended, the lower pressure foot then being extended toward the upper pressure foot to firmly clamp the workpieces between the upper and lower pressure feet. Once the foregoing step is completed it is possible to calculate the thickness of the workpieces at the desire riveting location. If the fastener is a slug, the desired upper and lower cavities can be calculated as the length of the slug has been programmed into the programmable process control means. (The desired upper and lower cavities for a slug are each one half of the difference between the length of the slug and the thickness of the workpieces.) If the fastener is a rivet, the desired upper and lower cavities can be calculated as the length of the rivet and the height of the rivet head has been programmed into the programmable process control means. (The desired upper cavity for a rivet is the height of the rivet head, and the desired lower cavity is the difference between the length of the tail of the rivet and the thickness of the workpieces.) The upper buck ram is then extended to the desire upper buck ram cavity position, and after this step has been completed the lower buck ram is extended to snugly engage the fastener between the upper and lower buck rams. Upsetting of the fastener takes place by extending the lower buck ram and simultaneously extending the upper buck ram, the movement being controlled by suitable servo valves, the upper buck ram being extended the same distance as the lower buck ram plus the distance required from a deflection compensation table which has been programmed into the programmable process control means. (The deflection compensation table sets forth the amount of deflection of the upper portion of the C-shaped frame for various forces as measured by the load cell.) This step will be continued until the desire upset force signal is receive from the load cell mounted on one of the buck rams. During upset of the fastener the upper pressure foot will be moved downwardly a distance required from the deflection compensation table, at least until fastener lock occurs. (Fastener lock, which is more commonly called slug lock, occurs when the fastener is bulged enough during upsetting to form an interference fit within the fastener receiving aperture.) After upset is completed, the upper pressure foot will be moved upwardly an amount equal to the downward movement from the preceding step and the upper and lower rams will be backed away until a no force signal is received from the load cell. After this step has been completed the upper and lower buck rams and the upper and lower pressure feet will be retracted to their initial starting position.

The foregoing will be more fully understood after a consideration of the following detailed description in which a preferred embodiment of the present invention is illustrated.

DETAILED DESCRIPTION

Figure 1:
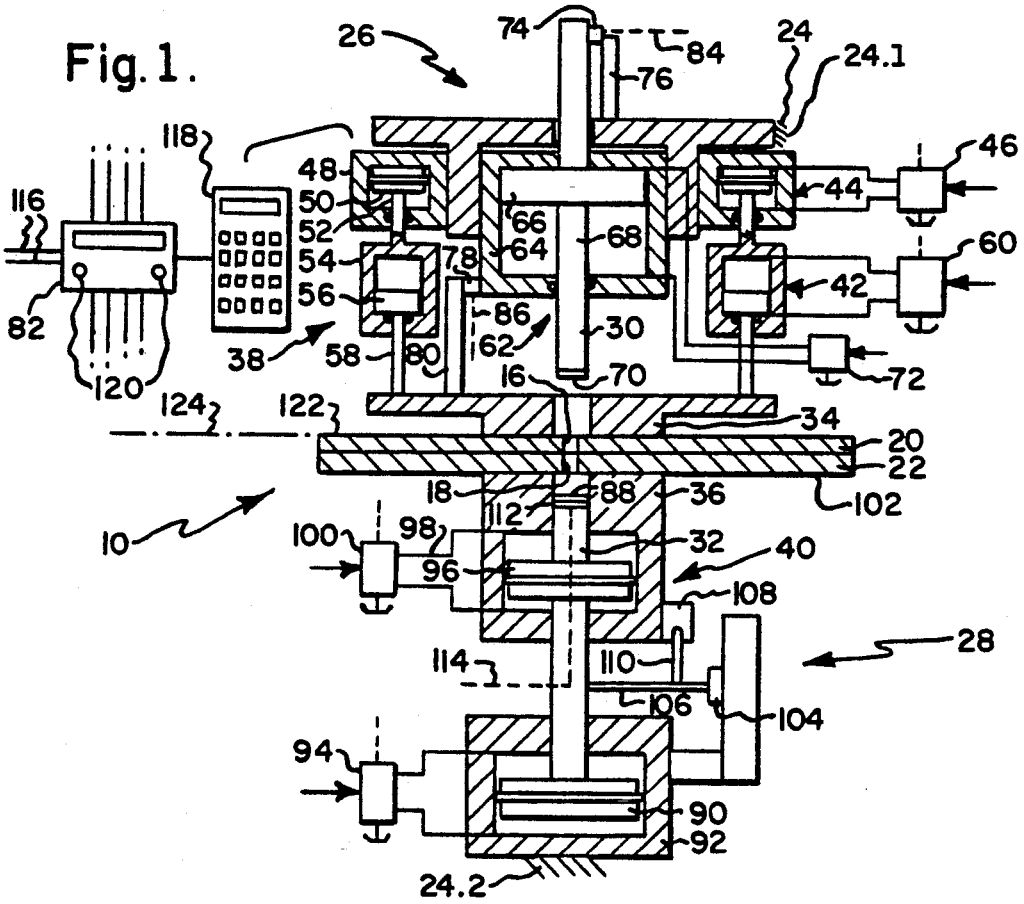
FIG. 1 is a schematic view of the apparatus of the present invention showing the parts in their initial clamping positions.
Figure 2:
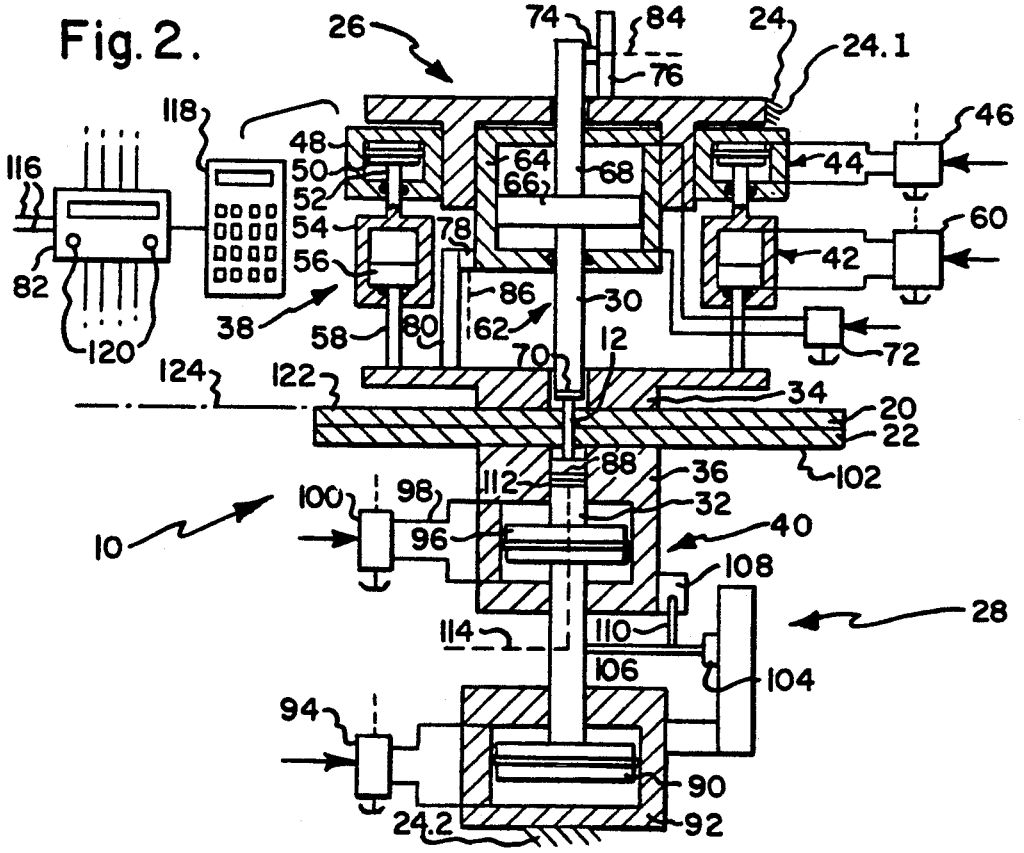
FIG. 2 is a view similar to FIG. 1, but showing the parts after a slug has been engaged by the upper and lower rams but before upset has been initiated.
Figure 3:
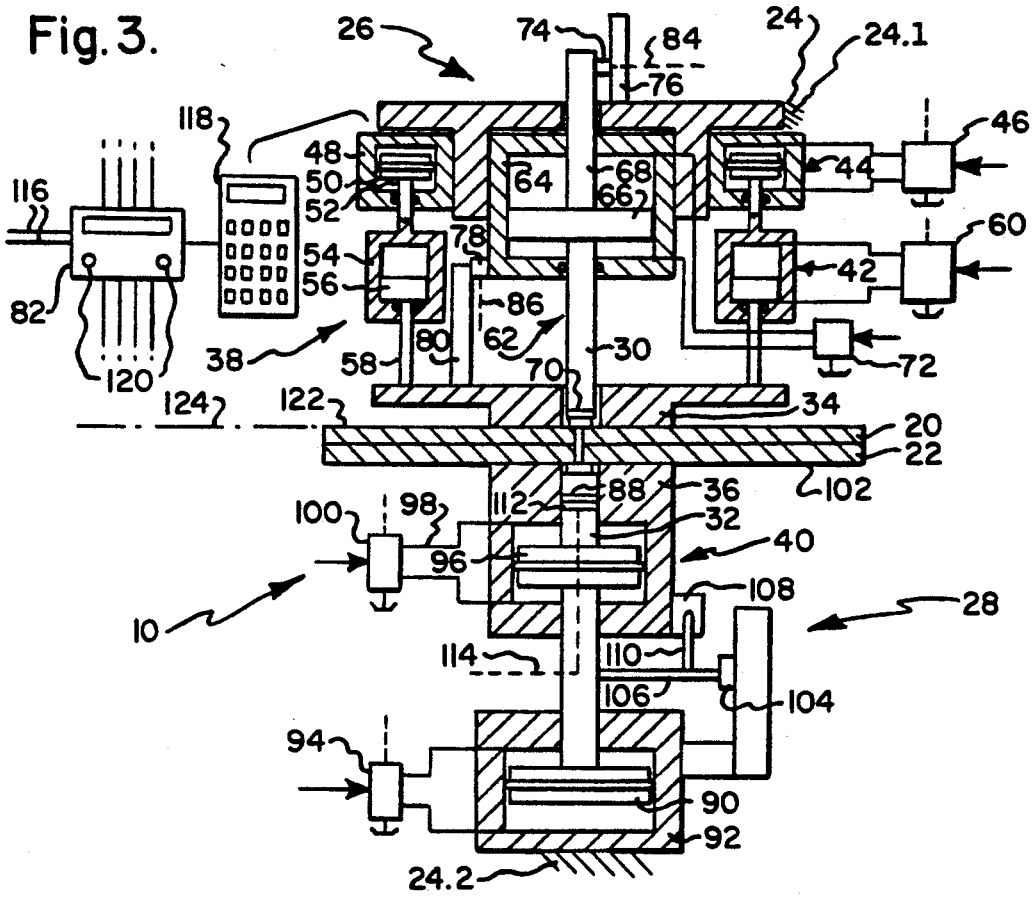
FIG. 3 is a view similar to FIGS. 1 and 2, but showing the parts in their positions immediately after the slug has been upset.
Figure 4:
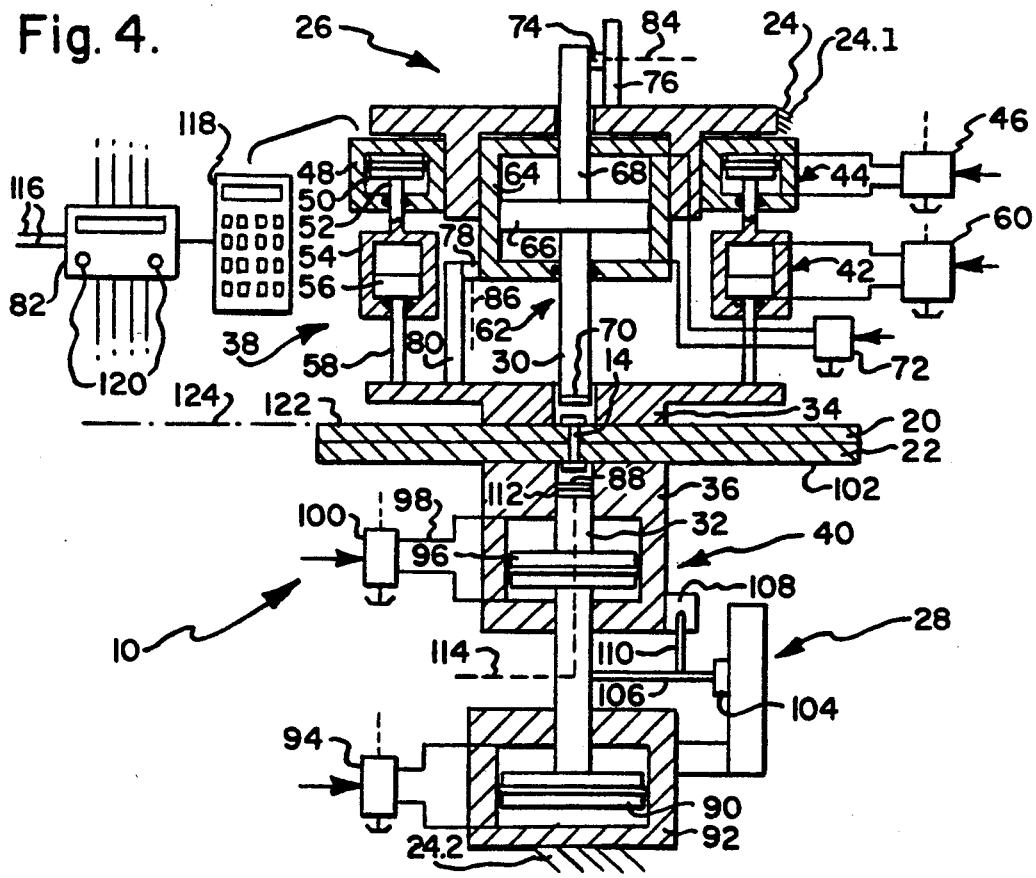
FIG. 4 is a view similar to the preceding FIGS. but showing the positions of the parts during back away.

Referring now to the drawings, the apparatus of this invention is indicated generally at 10, the apparatus being for the purpose of securing together two or more workpieces by a slug 12 (FIG. 2) which is to be upset into the shape shown at 14 (FIG. 4). As the machine of this invention may also be used for upsetting rivets, the terms "slug" and "rivet" will be used interchangeably hereafter. The slug 12 is initially inserted in a conventional manner into aligned apertures 16 and 18 in upper and lower workpieces 20 and 22, respectively. while only two workpieces 20 and 22 are shown in the various FIGS., it should be appreciated that more than two workpieces can be secured together.

The apparatus of this invention includes a frame, the upper portion of the frame being schematically illustrated at 24.1 and a lower portion of the frame being somewhat schematically illustrated at 24.2. The frame of the apparatus of this invention is typically mounted upon the floor for movement in X and Y directions in a horizontal plane only.

Mounted upon the upper and lower portions of the frame are upper and lower riveting rams assemblies indicated generally at 26 and 28, respectively. Each of the riveting rams assemblies include a buck ram, the upper buck ram being shown at 30, and the lower buck ram being shown at 32. Each riveting ram assembly also includes clamps or bushing in the form of upper and lower pressure feet 34, 36, respectively. The upper pressure foot 34 is supported by upper pressure foot moving means indicated generally at 38. Similarly, the lower ram clamp or lower pressure foot 36 is mounted for movement towards and away from the workpieces by lower pressure foot moving means 40.

The upper pressure foot moving means differs significantly from the lower pressure foot moving means and includes two or more cylinder assemblies of the two position type, which two position cylinders are indicated generally at 42, and an equal number of upper pressure foot compensation cylinder assemblies indicated generally at 44, each upper pressure foot compensation cylinder assembly 44 being under full servo position control by means of a servo valve assembly 46. As can be seen, each upper pressure foot compensation cylinder assembly 44 includes a double acting hydraulic cylinder 48 which is mounted upon the upper portion 24.1 of the frame, a piston 50 mounted within the double acting hydraulic cylinder 48, and a piston rod 52 connected to the piston 50 and extending downwardly out of the cylinder 48. Each of the two position cylinders 42 includes a cylinder 54 connected directly to the piston rod 52 for movement therewith. Mounted within the cylinder 54 is a piston 56, the piston in turn carrying a outwardly extended rod 58 to which the upper pressure foot 34 is rigidly secured. The fluid within each two position cylinder assembly 42 is controlled by a two position valve 60. In operation the piston rod can either be fully extended or fully retracted.

The upper buck ram 30 is moved by a buck ram moving means 62 which may consist of a cylinder 64 rigidly secured to an upper portion 24.1 of the frame, the cylinder 64 having mounted therein a piston 66 which carries a double ended piston rod 68. The lower end of rod 68 has a suitable anvil 70 mounted thereon, which anvil is adapted to contact the upper end of the slug 12 to upset it during the riveting operation. The position of the rod 68 is controlled by a servo valve assembly 72.

In order to provide suitable feedback to the servo valves 46 and 72, suitable position measuring means are provided. Thus, the position of the buck ram 30 is determined by buck ram position measuring means 74, which may be an encoder. This measuring means is mounted on a suitable bracket 76 which is in turn supported by the upper portion 24.1 of the frame. The position of the upper pressure foot is determined by the upper pressure foot measuring means 78 which is carried by a suitable bracket 80 mounted on the pressure foot 34, the upper pressure foot measuring means measuring the movement of the upper pressure foot 34 with respect to the frame 24.1. This measuring means may also be an encoder.

The measuring means 74 and 78 are connected to a programmable process control means 82 by means of suitable electrical wires 84 and 86. The process control means, or controller, is also connected with the valves 72 and 46 by other suitable electrical wires (no reference numerals) and is further connected with the two position control valve 60 by a further electrical wire (no reference numeral). The programmable process control means will be more fully described below.

The lower buck ram 32 consist of a piston rod which has an anvil 88 at its upper end. The piston rod 32 is connected to a piston 90 for movement therewith, the piston 90 being mounted within a cylinder 92 rigidly secured to a lower portion 24.2 of the frame. The movement of the piston 90 is under full servo control by means of a servo control valve 94. Mounted upon an upper portion of the piston rod 32 is the lower ram clamp or lower pressure foot 36 which, as can been seen, is a cylinder. The cylinder or pressure foot 36 is disposed about a piston 96 carried by an upper portion of the piston rod 32. The cylinder 36 will normally be extended upwardly by means of fluid introduced above the piston 96 through a fluid line 98, the fluid being under control of a pressure regulating valve 100 so that the lower pressure foot 36 will exert a constant upward pressure when the upper surface of the lower pressure foot 36 is bought into contact with the lower surface 102 of the lower workpiece 22. Thus, even though the lower ram 32, 88 may be moving relative to the pressure foot 36, constant clamping pressure will be achieved during the operation of the apparatus.

Proper position of the lower buck ram 32 is achieved by utilizing the feedback from a buck ram position measuring means in the form of an encoder 104 carried by a bracket 106 suitably mounted on an intermediate portion of the lower buck ram 32 between pistons 90 and 96. The movement of the lower pressure foot 36 with respect to the frame and also with respect to the lower ram 32 is determined by pressure foot position measuring means, which is preferably a linear velocity displacement transducer 108, carried by a further bracket 110, this bracket in turn being mounted on the bracket 106.

A load cell 112 is carried by the buck ram 32 immediately below the anvil 88. The load cell is capable of transmitting a force signal to the programmable process control means 82 by means of an electrical line 114 which extends outwardly from a mid portion of the piston 32, the electrical line 114 being connected not only to the load cell 112 but also the linear velocity displacement transducer 108 and the encoder 104.

The programmable process control means is connected to a source of electric power by power lines 116. It is additionally provided with data input means represented by the keyboard 118. The control means 82 may also be provided with various control devices 120 which may be used for dialing in the upset force and other factors.

In operation, the riveting apparatus of this invention is positioned with respect to the workpieces so that the upper and lower rams 30, 32 are in line with the position where the slug 12 is to be inserted. The workpieces 20 and 22 will also be suitably positioned so that the upper surface 122 of the upper workpiece 20 lies in the desired workplane, which is indicated by the broken line 124. In this respect it should be remembered that the workpieces may be mounted in such a manner that the ends of the workpieces can be moved independently up and down, and also in such a manner that the workpieces can be rotated about an axis which extends generally from one end of the workpieces to the other end. Because of the independent movement of the ends of the workpieces, and also since the workpieces can be rotated, it is relatively easy to position the uppermost surface of the upper workpiece in the desired workplane at the desired location. During the movement of the workpieces the upper and lower bucking rams, as well as the upper and lower clamps, are in their retracted or opened position. Once the workpieces and the apparatus have been properly positioned with respect to each other, the operation of the apparatus 10 will commence.

Initially the programmable process control means 82 will have programmed into it the length of the rivet or slug 12 which is to be inserted, maximum upset force, and other factors including a deflection compensation table for the frame. As a practical matter, as the deflection compensation table remains constant for each apparatus, it may be programmed in during the completion of the building process for the particular apparatus. The table may be based upon either calculated data or test data, and it will indicate how much the upper portion 24.1 will deflect for various loads applied by the buck rams 30,32. For example, if the upper ram were to be moved downwardly with a force of 1000 pounds, the upper portion 24.1 will deflect a first slight amount. If the force is increased to 10,000 pounds the upper portion 24.1 will deflect a second amount greater than the first amount. These various deflection amounts are stored in the deflection compensation table, which amounts are in turn fed into the programmable process control means.

Once the process control means has received the necessary data for the operation of the machine, the upper pressure foot will be extended. Initially though it should be noted that the pressure foot compensation cylinders 44 will be fully retracted at the beginning of the operation as well as the two position upper pressure foot cylinder assemblies 42. At the beginning of the clamp cycle, the two position valve 60 will be shifted to cause fluid to be introduced into the anchor end of the cylinder 54, forcing the piston 56 and the piston rods 58 as far down as they will go. As the frame 24 has been properly positioned, when the upper pressure foot 34 has been fully extended, its lower surface will lie in the workplane 124.

Once the upper pressure foot has been fully extended to its lower position, the lower pressure foot is extended upwardly towards the upper pressure foot to clamp the workpieces. This is done by causing valve 94 to introduce fluid into the cylinder 92 below the piston 90. As the lower pressure foot is being moved upwardly the programmable process control means will monitor the linear velocity displacement transducer 108. As soon as any motion is detected by the pressure foot measuring means 108, the programmable process control means will cause the valve 94 to stop further upward movement of piston 90 and rod 32, and to maintain that position. As this stopping of movement will not be instantaneous the amount of lower pressure foot 36 collapsed is measured with the lower ram encoder 104 and the linear velocity displacement transducer 108. The thickness of the clamped workpieces can now be determined as the position of the frame and lower surface of the upper pressure foot are known from the initial set-up, and as the position of the lower pressure foot relative to the lower portion 24.2 of the frame is known from the measurements made by the encoder 104 and transducer 108. As the length of the slug or rivet is also known, it is then possible to calculate the desired upper and lower buck ram cavities.

If the apertures 16 and 18 have not previously been formed in the workpieces, they will now be drilled. As can be seemed from the aforementioned U.S. Pat. No. 4,908,928, a drill may be mounted on a sub-frame which also carries the upper buck ram, the drill being indexed to its proper drilling position. After drilling, the parts are indexed so that the upper buck ram will be in is desirable operational position for inserting a rivet or slug into the workpieces. The fastener may be positioned for insertion in a number of different ways and two examples are shown in U.S. Pat. Nos. 4,609,134 and 4,819,856. In each of these devices the rivet or slug is positioned below the upper buck ram and as the upper buck ram commences its downward movement the rivet or slug will be inserted into the workpieces.

At the conclusion of the fastener insertion step, the upper buck ram will be extended to the desired upper buck ram cavity position. In this connection it should be noted the upper buck ram is under the control of the programmable process control means 82 which receives position information from the pressure foot measuring means 78 and causes the servo control valve 72 to properly move the upper buck ram downwardly until it has achieved its upper buck ram cavity position. The lower buck ram 32 is now extended upwardly by the programmable process control means via servo valve 94, the position of the buck ram being known from encoder 104. Upward movement will be stopped when the lower buck ram reaches the lower cavity position preferably plus 0.005 inches to insure that the rivet or slug is snugly engaged between the anvils 70 and 88. At this time the load cell 112 should register a snug force, showing that a proper length fastener has been inserted and that there is contact between the upper buck, the fastener and the lower ram.

Upon completion of the insertion and snug phase, the upsetting of the fastener begins. The lower ram 32 extends and simultaneously the upper buck 30 extends the same distance relative to the upper portion 24.1 plus the distance required from the deflection compensation table for C-frame deflection for the force being applied, which force is being measure by the load cell 112. During this operation, the position of the rams 30 and 32 will be controlled by the process control means through servo valves 72 and 94, the programmable process control means 82, which modulates the sequential operation of the apparatus, receiving feedback information from the various encoders and the linear displacement velocity transducer. This upsetting operation by the rams will continued until the desired upset force signal is received from the load cell. The pressure foot compensation cylinder 44 will be caused to extend a distance determined from the deflection compensation table until fastener or slug lock occurs, the extension being controlled by the controller 82 which causes valve 46 to move piston 50 downwardly until a proper feedback signal is received from encoder 78. Once slug lock has occurred, the pressure foot compensation cylinder 44 may be locked out, and the two position upper pressure foot cylinder assembly 42 and the lower clamp cylinder assembly 40 may be subjected to the same hydraulic pressure, the pressure foot cylinder 42 becoming resilient. While the lower ram 32 is extending, the clamp linear velocity displacement transducer 108 and ram encoder 104 monitor the lower rivet cavity for upset head height, determining both a minimum and maximum range.

After upset is complete the upper pressure foot is fully retracted by the compensation cylinder and the upper and lower rams are backed away until a no force signal is received from the load cell 112. The pressure foot cylinders 42 are also fully extended.

If the frame is a floor mounted machine, as describe above, the lower ram maintains position control at a position equal to the position reached at the desired upset value, as the upper buck returns to its retracted position. If the C-frame is not floor mounted, both the upper buck and lower rams are returned at an equal rate. Once the load cell value reaches zero the lower ram retracts to the stroke position and the upper buck is retracted to the full up position.

It will be understood that the foregoing description and illustrations are by way of example only, and that such changes and modifications as may suggest themselves to those skilled in the art are intended to fall within the scope of the present invention as defined by the appended claims.

What is claimed is:

1. A method for fastening together two or more side-by-side workpieces while maintaining the upper surface of the upper workpiece in a desired workplane, the method comprising the following steps:

providing an apparatus including programmable process control means, a frame having upper and lower portions, upper and lower riveting ram assemblies carried by the upper and lower portions of the frame, respectively, each riveting ram assembly including a buck ram, buck ram moving means, a pressure foot, pressure foot moving means, a buck ram position measuring means for measuring the position of the associated buck ram over a range of movement with respect to the frame, and a pressure foot position measuring means for measuring the position of the associated pressure foot over a range of movement with respect to the frame, one of the buck rams carrying a load cell for sending a force signal in response to the force being applied to a fastener during upset and thereafter;

programming into the process control means the length of a fastener and a deflection compensation table for the frame;

positioning the upper pressure foot with its lower surface at the desired workplane;

extending the lower pressure foot towards the upper pressure foot to clamp the workpieces;

calculating the thickness of the clamped workpieces;

calculating desired upper and lower buck ram cavities each as a function of a dimension of the fasteners and the thickness of the workpieces;

extending the upper buck ram to the desired upper buck ram cavity position;

extending the lower buck ram to snugly engage the fastener;

upsetting the fastener by extending the lower buck ram and simultaneously extending the upper buck ram the same distance plus a distance required from the deflection compensation table for the force being applied until a desired upset force signal is received from the load cell;

moving the upper pressure foot downwardly a distance required from the deflection compensation table during upset of the fastener, at least until the fastener is bulged enough during upsetting to form an interference fit in the workpieces;

after upset moving the upper pressure foot upwardly an amount equal to the distance required from the deflection compensation table during upset of the fastener, and backing away at least one of the upper and lower rams until a no force signal is received from the load cell; and retracting the upper and lower buck rams and the upper and lower pressure feet to their initial starting positions.

2. The method of fastening together two or more side-by-side workpieces as set forth in claim 1 wherein the said fastener is inserted into the workpieces after the workpieces have been clamped together by the upper and lower pressure feet.

3. The method of fastening together two or more side-by-side workpieces as set forth in claim 1 further including the step of monitoring ram cavity for upset head height with the lower buck ram position measuring means and the lower pressure foot position measuring means.

4. The method of fastening together two or more side-by-side workpieces as set forth in claim 1 wherein only the upper buck ram is backed away after upset until a no force signal is received.

5. The method of fastening together two or more side-by-side workpieces as set forth in claim 1 wherein both the upper and lower buck rams are backed away at an equal rate until a no force signal is received.

6. The method of fastening together two or more side-by-side workpieces as set forth in claim 1 wherein an upper pressure foot compensation cylinder is provided which interconnects the upper pressure foot moving means with the frame, the compensation cylinder normally being retracted, wherein the upper pressure foot is moved downwardly during upset of the fastener by extending the compensation cylinder, and wherein the upper pressure foot is moved upwardly after upset by retracting the compensation cylinder.

7. The method of fastening together two or more side-by-side workpieces as set forth in claim 6 wherein the upper pressure foot is not moved downwardly during upset after the fastener is bulged enough during upsetting to from an interference fit in the workpieces.

8. The method of fastening together two or more side-by-side workpieces as set forth in claim 7 wherein both the upper and lower buck ram moving means apply forces to the fastener after the fastener is bulged enough during upsetting to form an interference fit on the workpieces, in such a manner that there is no movement of the workpieces.

9. The method of fastening together two or more side-by-side workpieces as set forth in claim 6 wherein after a desired upset force is reached during upset a pressure foot compensation cylinder assembly is retracted and the upper pressure foot moving means is extended.

10. A method for fastening together two or more side-by-side workpieces while maintaining the upper surface of the upper workpiece in a desired workplane; the method comprising the following steps:

providing an apparatus including programmable process control means, a frame having upper and lower portions, upper and lower riveting ram assemblies carried by the upper and lower portions of the frame, respectively, each riveting ram assembly including a buck ram, buck ram moving means, a pressure foot, pressure foot moving means, an upper pressure foot compensation cylinder which interconnects the upper pressure foot moving means with the frame, a buck ram position measuring means for measuring the position of the associated buck ram over a range of movement with respect to the frame, and a pressure foot position measuring means for measuring the position of the associated pressure foot over a range of movement with respect to the frame, one of the buck rams carrying a load cell for sending a force signal in response to the force being applied to a fastener during upset and thereafter;

programming into the process control means the length of a fastener and a deflection compensation table for the frame;

positioning the upper pressure foot with its lower surface at the desired workplane, with the upper pressure foot compensation cylinder in its fully retracted position;

extending the lower pressure foot towards the upper pressure foot to clamp the workpieces;

calculating the thickness of the clamped workpieces and desired upper and lower buck ram cavities each as a function of a dimension of the fasteners and the thickness of the workpiece;

inserting a fastener into the workpieces after the workpieces have been clamped together by the upper and lower pressure feet and extending the upper buck ram to the desired upper buck ram cavity position;

extending the lower buck ram to snugly engage the fastener;

upsetting the fastener by extending the lower buck ram and simultaneously extending the upper buck ram the same distance plus a distance required from the deflection compensation table for the force being applied until a desired upset force signal is received from the load cell;

extending the compensation cylinder to move the upper pressure foot downwardly a distance required from the deflection compensation table during upset of the fastener, at least until the fastener is bulged enough during upsetting to form an interference fit in the workpieces;

moving the upper pressure foot after upset by fully retracting the compensation cylinder;

backing away at least one of the upper and lower rams after upset until a no force signal is received from the load cell; and retracting the upper and lower buck rams and the upper and lower pressure feet to their initial starting positions.

11. An apparatus for fastening together two or more side-by-side workpieces while maintaining the upper surface of the upper workpiece in a desired workplane; the apparatus comprising:

a frame having upper and lower portions;

upper and lower riveting ram assemblies carried by upper and lower portions of the frame, respectively, each riveting ram assembly including a buck ram, buck ram moving means, a pressure foot, pressure foot moving means, a buck ram position measuring means for measuring the position of the associated buck ram over a range of movement with respect to the frame, and a pressure foot position measuring means for measuring the position of the associated pressure foot over a range of movement with respect to the frame;

a load cell carried by one of the buck rams for sending a force signal in response to the force being applied to a fastener during upset and thereafter; and programmable process control means capable of having programmed into it a deflection compensation table and the length of a fastener, the programmable process control means modulating sequential operation of said block ram moving means and pressure foot moving means to move the buck rams and the pressure feet in response to signals received from the position measuring means and the load cell in such a manner that the fastener may be upset while maintaining the upper surface of the upper workpiece in the desired workplane even though one portion of the frame may deflect more than another portion of the frame.

12. The apparatus as set forth in claim 11 wherein the lower riveting ram assembly includes spaced apart upper and lower pistons mounted on a common piston rod, the upper end of the rod having an anvil mounted thereon, which anvil acts at the lower buck ram, a pressure foot cylinder being mounted about the upper piston and normally being biased to an extended position by fluid pressure under a relatively upward constant pressure, the pressure foot cylinder acting as a lower pressure foot, a lower cylinder secured to a lower portion of the frame, hydraulic fluid introduced into the lower cylinder causing the lower cylinder to be moved, and wherein the lower pressure foot measuring means is mounted on the common piston rod.

13. The apparatus as set forth in claim 12 wherein the buck ram position measuring means is mounted on the common piston rod.

14. The apparatus as set forth in claim 11 wherein the upper pressure foot moving means includes a two position cylinder assembly and an upper pressure foot compensation cylinder assembly.

15. The apparatus as set forth in claim 14 wherein the upper pressure foot compensation cylinder assembly includes a double acting hydraulic cylinder mounted on the frame, a piston within the cylinder, and a piston rod connected to the piston and extending downwardly out of the cylinder, and wherein the two position cylinder assembly is carried by the piston rod.

* * * * *